US008029236B2

(12) United States Patent
Chang et al.

(10) Patent No.: US 8,029,236 B2
(45) Date of Patent: Oct. 4, 2011

(54) HEAT DISSIPATION FAN

(75) Inventors: Shun-Chen Chang, Taoyuan Hsien (TW); Chia-Ming Hsu, Taoyuan Hsien (TW); Tsung-Yu Lei, Taoyuan Hsien (TW); Chin-Sheng Liu, Taoyuan Hsien (TW); Peng-Chu Tao, Taoyuan Hsien (TW); Chia-Ching Lin, Taoyuan Hsien (TW); Shih-Wei Huang, Taoyuan Hsien (TW); Ching-Chuang Mai, Taoyuan Hsien (TW); Wen-Shi Huang, Taoyuan Hsien (TW); Hsiou-Chen Chang, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 698 days.

(21) Appl. No.: 11/709,165

(22) Filed: Feb. 22, 2007

(65) Prior Publication Data

US 2007/0286727 A1 Dec. 13, 2007

(30) Foreign Application Priority Data

Jun. 8, 2006 (TW) ..... 95120366 A
Jul. 6, 2006 (TW) ..... 95124606 A

(51) Int. Cl.
*F04D 19/02* (2006.01)
*F04D 25/16* (2006.01)

(52) U.S. Cl. ..... 415/199.5; 415/211.2; 415/220; 416/198 R

(58) Field of Classification Search ..... 415/199.5, 415/211.2, 220; 416/198 R; 417/423.8, 417/350

See application file for complete search history.

(56) References Cited

U.S. PATENT DOCUMENTS

| | | | | |
|---|---|---|---|---|
| 2,037,395 | A * | 4/1936 | Seelig | 415/160 |
| 6,540,479 | B2 * | 4/2003 | Liao et al. | 415/199.5 |
| 6,663,342 | B2 * | 12/2003 | Huang et al. | 415/121.2 |
| 2002/0159883 | A1 * | 10/2002 | Simon et al. | 415/193 |
| 2005/0046284 | A1 * | 3/2005 | Kudo et al. | 310/58 |
| 2006/0045736 | A1 * | 3/2006 | Lee et al. | 415/220 |
| 2007/0284955 | A1 * | 12/2007 | Chang et al. | 310/59 |
| 2007/0286720 | A1 * | 12/2007 | Chang et al. | 415/198.1 |
| 2007/0286721 | A1 * | 12/2007 | Chang et al. | 415/199.5 |

FOREIGN PATENT DOCUMENTS

JP 54009007 A * 1/1979

* cited by examiner

*Primary Examiner* — Justine Yu
*Assistant Examiner* — Jesse Prager
(74) *Attorney, Agent, or Firm* — Birch, Stewart, Kolasch & Birch, LLP

(57) ABSTRACT

A heat dissipation fan includes a housing, a first rotor, a second rotor, a base and a plurality of static blades. The first rotor has a shaft and a plurality of rotor blades. The second rotor is coupled to the first rotor and has a plurality of rotor blades. The base is disposed in the housing for supporting the first and second rotors. The static blades are disposed between the housing and the base, wherein a rear portion of each static blade extends along an axial line of the heat dissipation fan for improving the working efficiency of the second rotor.

14 Claims, 5 Drawing Sheets

HEAT DISSIPATION FAN

BACKGROUND OF THE INVENTION

1. Field of the Invention

The invention relates to a heat dissipation fan, and more particularly to a heat dissipation fan with improved efficiency.

2. Description of the Related Art

Currently, with increased heat generation in electronic elements, conventional convection methods are unable to dissipate heat sufficiently. Thus, heat dissipation fans are required.

Conventional heat dissipation fans provide dissipation efficiency of about 15~30%. However, this efficiency is too low. Additionally, conventional heat dissipation fans generate additional heat into the system, thereby decreasing dissipation efficiency thereof. A high-power heat dissipation fan is thus required, and more energy is in turn wasted.

FIG. 1 shows a conventional fan, including a housing 10, a motor 12, a base 15 and a rotor. The base 15 is connected to the housing 10 via ribs 14 to support the motor 12. Conventionally, the heat of the fan is dissipated via an exposed metal shell 11 of the rotor. However, when the volume of the motor 12 decreases, the heat cannot be sufficiently dissipated.

Additionally, in theory, blades 13 of the rotor can provide dissipation efficiency of about 75~85%. However, conventional heat dissipation fans only provide the total dissipation efficiency of about 15~30%. Eliminating efficiency loss of the motor, in practice, blades 13 only provide dissipation efficiency of about 20~45%. Thus, conventional heat dissipation fans must be modified to achieve improved dissipation efficiency.

BRIEF SUMMARY OF THE INVENTION

A detailed description is given in the following embodiments with reference to the accompanying drawings.

The invention provides a heat dissipation fan, the heat dissipation efficiency and space utilization of which are optimized by the height ratio of the rotor blades to the static blades, rotor and static blade numbers, and improved static blade design.

In an embodiment of the invention, the heat dissipation fan includes a housing, a first rotor, a second rotor, a base, and a plurality of static blades. The first rotor comprises a shaft and a plurality of rotor blades. The second rotor couples to the first rotor and comprises a plurality of rotor blades. The base is disposed in the housing for supporting the first and second rotors. The static blades are disposed between the housing and the base, wherein a rear portion of each static blade extends along an axial line of the heat dissipation fan, improving efficiency of the second rotor.

In a modified embodiment, a length of the rear portion is ⅓ to ⅕ of that of the static blade.

The second rotor is disposed on the lee side of the first rotor. An end of the shaft passes through a top surface of a hub of the second rotor to be fixed thereon by riveting, screwing, adhesion or other equivalent means. The first rotor and the second rotor rotate at the same speed.

The heat dissipation fan includes a first air-guiding shroud disposed on a side of the housing and a second air-guiding shroud disposed on another side of the housing. The first or second air-guiding shroud includes a plurality of static blades disposed therein. The first air-guiding shroud or the second air-guiding shroud expands outward in a flared shape. The first air-guiding shroud and the second air-guiding shroud are connected to the housing by wngaging, riveting, screwing, adhesion, or other equivalent means.

The first rotor and the second rotor include a hub, and the rotor blades disposed around the hub. The hub of the first rotor is conical or tapered, or has an inclined surface. Each of the hubs of the first and second rotors comprises a plurality of heat dissipation holes for allowing airflow to pass therethrough so as to dissipate an internal heat of the fan. An inner surface of each heat dissipation hole is inclined. The hub of the second rotor is cup-shaped.

In a modified embodiment, the number of rotor blades of the first rotor is different from that of the second rotor. The number of rotor blades of the first rotor is 9, and the number of rotor blades of the second rotor is 8 or 5. The number of rotor blades of the first rotor is 8, and the number of rotor blades of the second rotor is 9 or 5. The number of static blades is 7.

In a modified embodiment, a height ratio of the rotor blades to the static blades ranges from 1:1.1 to 1:1.4. A height ratio of the rotor blades to the static blades ranges from 1:1.6 to 1:2.2.

The housing further comprises a plurality of connecting portions, and the heat dissipation fan is fixed on an external system frame via holes thereof.

The heat dissipation fan further comprises a driving device, disposed through the base to actuate the first and second rotors.

In another embodiment of the invention, a heat dissipation fan is provided, comprising a housing, a first rotor, a second rotor, a base and a plurality of static blades. The first rotor comprises a shaft and a plurality of rotor blades. The second rotor couples to the first rotor and comprises a plurality of rotor blades. The base is disposed in the housing supporting the first and second rotors. The static blades are disposed between the housing and the base, wherein a height ratio of the rotor blades to the static blades ranges from 1:1.1 to 1:2.2.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
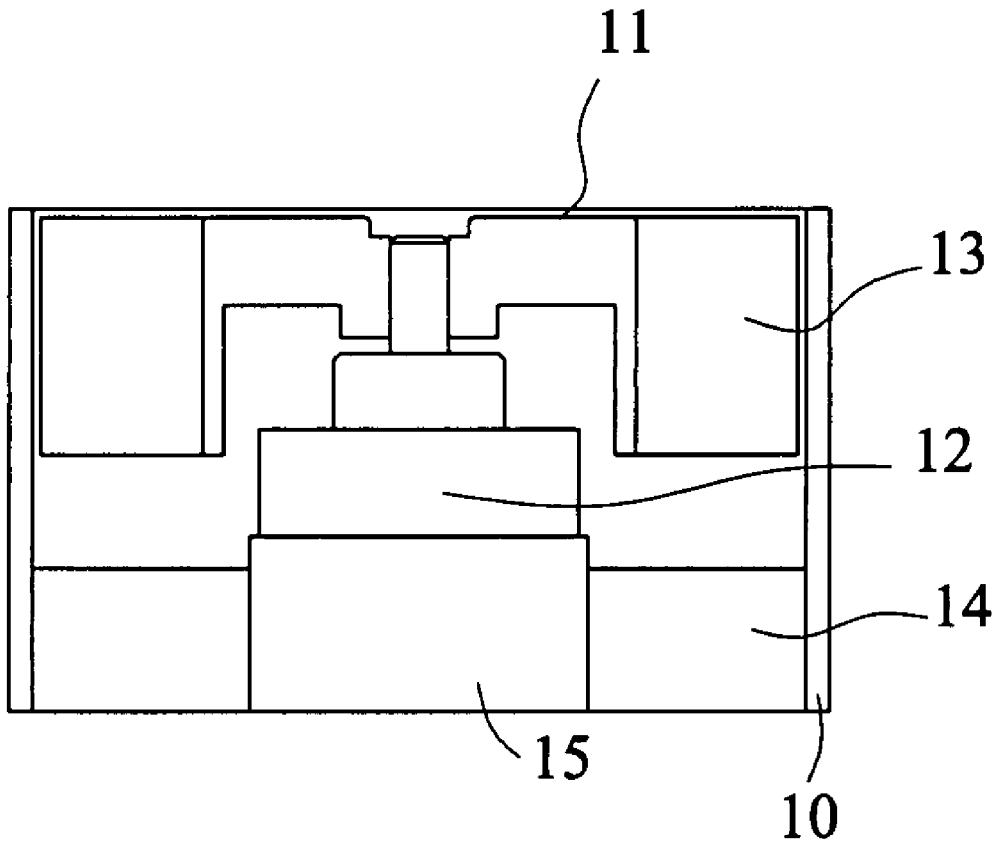
FIG. 1 (RELATED ART)
FIG. 1 is a sectional view of a conventional fan.
Figure 2:
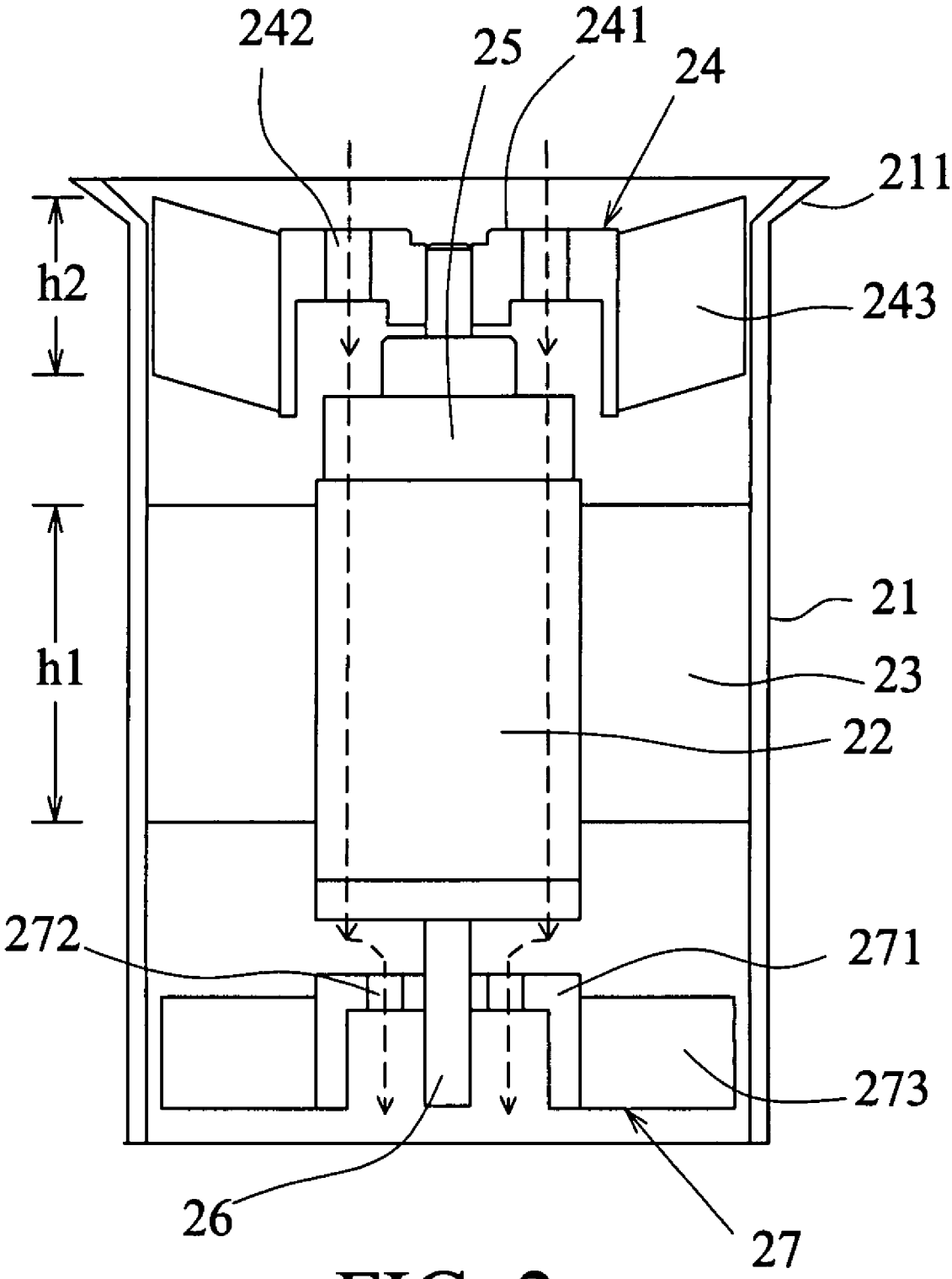
FIG. 2 is a sectional view of a heat dissipation fan of a first embodiment of the invention.

FIG. 2 shows a first embodiment of a heat dissipation fan of the invention. The fan includes a housing 21, a base 22 disposed in the housing 21, a plurality of static blades 23 disposed between the base 22 and the housing 21, a first rotor 24, a driving device 25 (for example, a motor) disposed through the base 22 and supported thereby, a shaft 26, and a second rotor 27. The second rotor 27 is disposed on a rear end (lee side) of the first rotor 24. An end of the shaft 26 passes a top surface of a hub 271 of the second rotor 27 and is fixed thereon. The inner portion of the hub 271 of the second rotor 27 is cup-shpaed. The shaft 26 is fixed to the second rotor 27 by riveting, screwing, adhesion, or other equivalent means. The driving device 25 can drive the first rotor 24 and the second rotor 27 via the shaft 26 to rotate the first rotor 24 and the second rotor 27 at the same speed.

A plurality of heat dissipation holes 242 are formed on the top surface of the hub 241 of the first rotor 24. A plurality of heat dissipation holes 272 are formed on the top surface of the hub 271 of the second rotor 27. When the first rotor 24 and the second rotor 27 are rotated by the driving device 25, airflow through the heat dissipation holes 242 and the heat dissipation holes 272 (as shown by the dotted lines) dissipates heat generated by the driving device 25 to elongate the used life thereof. The first rotor 24 includes a plurality of rotor blades 243. The second rotor 27 includes a plurality of rotor blades 273. The rotor blades 243 of the first rotor 24 incline upward. A windward side of the housing 21 includes an expanding portion 211 to increase intake airflow.

In terms of hydrodynamics, the rotation of the rotor blades will generate a pressure difference so as to generate airflow. However, when the air flow is discharged from the fan, it has an angle speed at the flow direction, thereby resulting in energy loss and decreasing heat dissipation efficiency. Further, in terms of flow field analysis, it will cause energy loss due to the generation of eddy on the heat dissipation fan. Moreover, when the airflow pass through the surface of rigid body, a shearing force is generated by friction, thereby causing energy loss. The gap between the tip of the rotor blades and the inner wall of the housing will also cause energy exhaust. The invention utilizes the Taguchi Method to obtain the optimum height ratio between the rotor and static blades. The static blades 23 guide airflow to reduce eddies, modify the angle speed to axial work, and improve the heat dissipation efficiency of the fan. When a ratio of a height h2 of the rotor blades 243 to a height h1 of the static blades 23 ranges from 1:1.6 to 1:2.2, the heat dissipation fan has the best efficiency and usage rate of space. The efficiency of the heat dissipation fan of the invention can be enhanced up to 45%. Eliminating the efficiency loss of the motor, the efficiency of the blades is thus about 60%. Alternatively, the ratio of the height h2 of the rotor blades 243 to the height h1 of the static blades 23 can also range from 1:1.1 to 1:1.4.

Figure 3C:
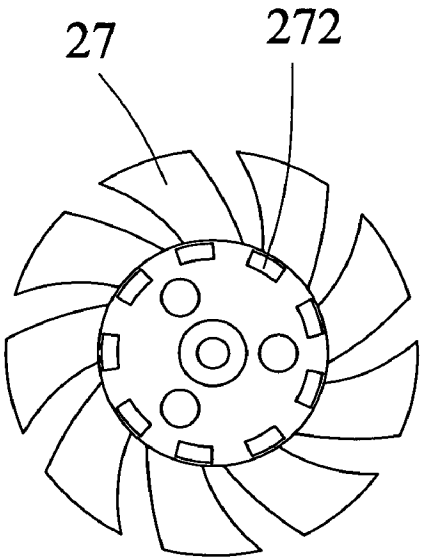
FIGS. 3A-3C are top views of the first rotor, the static blades and the second rotor.
Figure 3B:
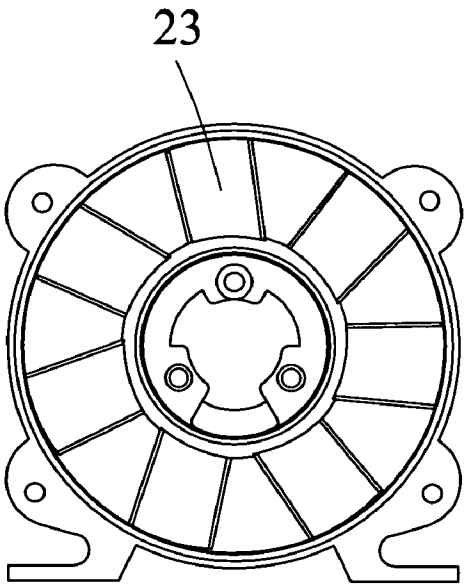
Figure 3A:
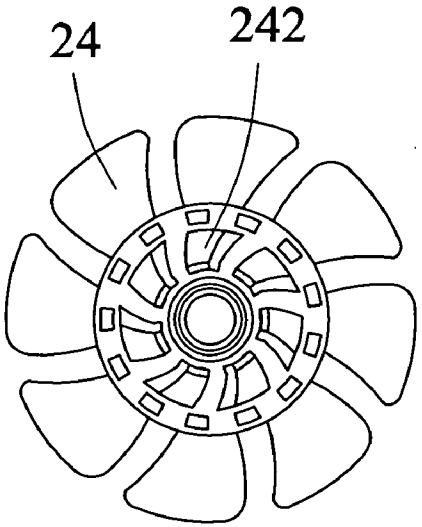

The number of rotor blades 243 of the first rotor 24 is different from that of the second rotor 27. For example, the number of rotor blades of the first rotor 24 can be 8, and the number of rotor blades 273 of the second rotor 27 is 9 or 5. In this embodiment, as shown in FIGS. 3A to 3C, the number of the static blades 23 is 7, and noise of the heat dissipation fan is thus reduced. Alternatively, the number of rotor blades of the first rotor is 9, and the number of rotor blades of the second rotor is 8 or 5.

Figure 4:
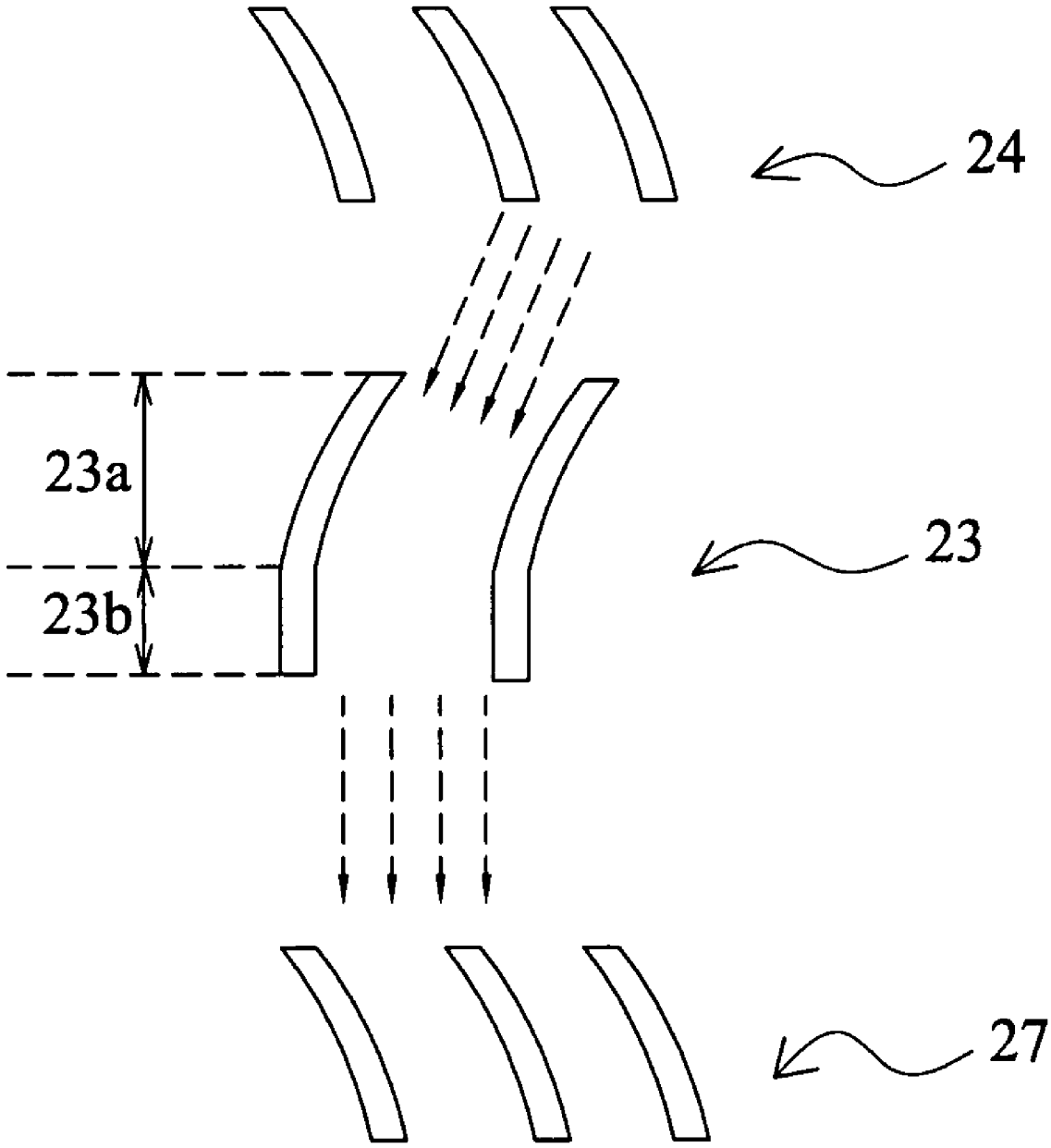
FIG. 4 is a schematic diagram of rotor blades of first rotor, static blades and rotor blades of second rotor.

Static blades 23 in the housing 21 can improve working efficiency of the second rotor 27, and increase the airflow pressure. As shown in FIG. 4, the tail ends of the static blades 23 are vertical design; in other word, the front portion 23*a* is curved, and the rear portion 23*b* is vertical and extends parallel to a center axis of the heat dissipation fan. Thus, the working efficiency of the second rotor 27 can be greatly improved. Preferably, the length of the rear portion 23*b* is about ⅓ to ¼ of that of the static blade 23. The rear portion 23*b* is vertical and parallel to the center axis of the heat dissipation fan. Thus, the efficiency of the rear portion 23*b* is enhanced and the performance of the heat dissipation fan is optimized.

Figure 5:
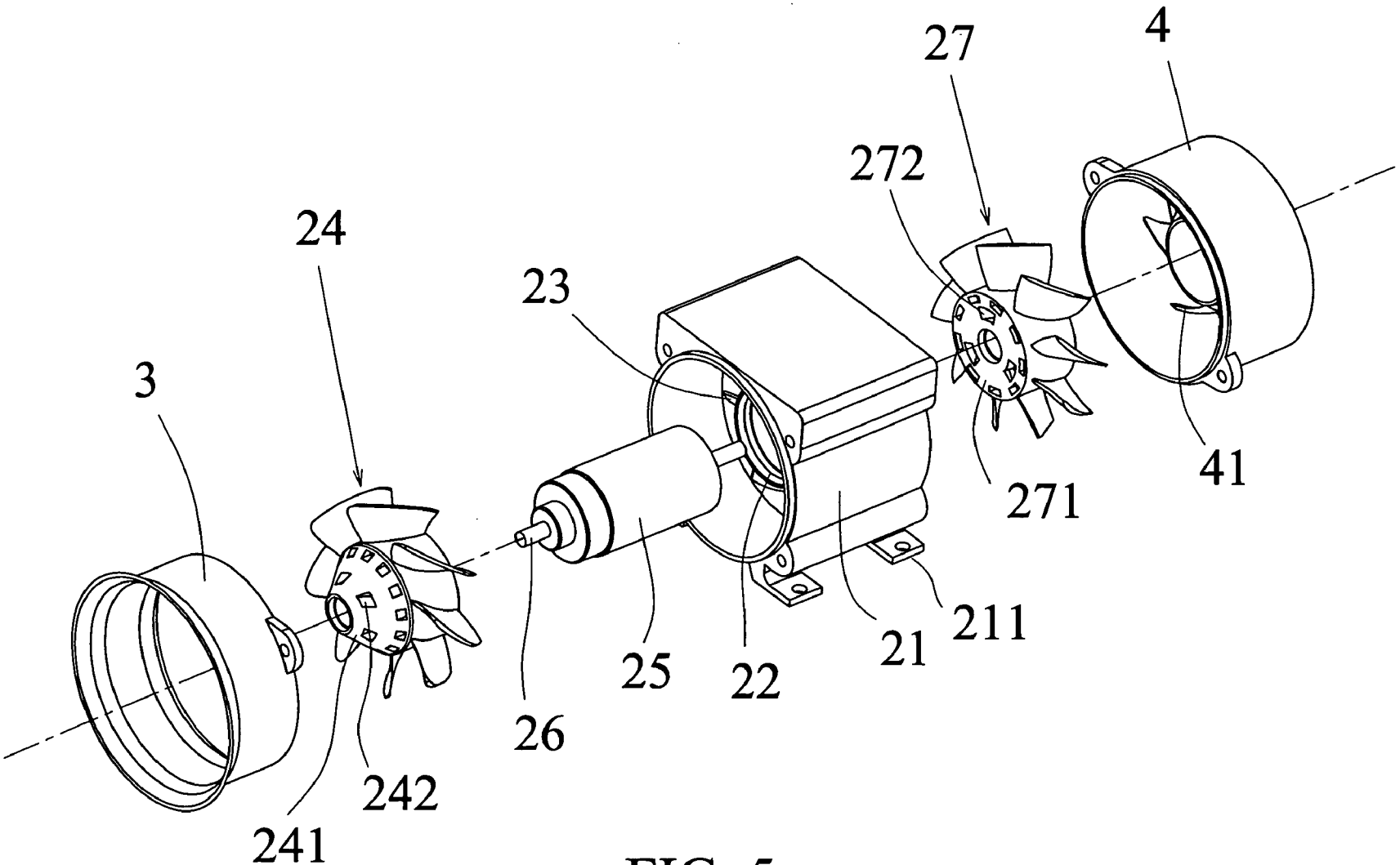
FIG. 5 is an exploded view of a heat dissipation fan of a second embodiment of the invention.

FIG. 5 shows a heat dissipation fan of the second embodiment of the invention, the structure of which is similar to that of the above-described embodiment except that the hub 241 of the first rotor 24 is conical or tapered, or has an inclined surface, and the inner walls of the heat dissipation holes 242 are inclined. Additionally, the heat dissipation fan further includes a first air-guiding shroud 3 and a second air-guiding shroud 4 respectively disposed on opposite sides of the housing 21. The second air-guiding shroud 4 further includes a plurality of static blades 41 to increase airflow pressure and improve heat dissipation efficiency. The first air-guiding shroud 3 can further include a plurality of static blades. The first air-guiding shroud 3 and the second air-guiding shroud 4 expand outward or are flared, and coupled to the housing 21 by engaging, riveting, screwing, adhesion, or other equivalent means. The housing 21 further includes a plurality of connecting portions 211, and the heat dissipation fan is fixed on an external system frame via holes formed on the connecting portions 211.

The invention provides a heat dissipation fan with optimum heat dissipating efficiency, which is achieved by adjusting the height ratio of the rotor blades to static blades, the collocating numbers of the rotor and static blades, and the shaped design of static blades. Thus, the heat dissipation efficiency and usage rate of space are optimized.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A heat dissipation fan comprising a housing;

a first rotor comprising a shaft and a plurality of rotor blades;

a second rotor coupled to the first rotor and comprising a plurality of rotor blades;

a base disposed in the housing for supporting the first and second rotors and comprising a single motor disposed through the base and supported thereby for driving the first and second rotors;

a plurality of static blades disposed between the housing and the base, wherein a front portion of each static blade is curved, and a rear portion of each static blade extends straightly along an axial line of the heat dissipation fan, wherein a stagger angle of the rotor blades of the first rotor differs from a stagger angle of the rotor blades of the second rotor;

a first air-guiding shroud disposed on a side of the housing, wherein the first air-guiding shroud expands outward or is flared; and a second air-guiding shroud disposed on another side of the housing, wherein the second air-guiding shroud comprises a plurality of static blades disposed therein.

2. The heat dissipation fan as claimed in claim 1, wherein a length of the rear portion is ⅓ to ⅕ of that of the static blade.

3. The heat dissipation fan as claimed in claim 1, wherein the second rotor is disposed on the lee side of the first rotor.

4. The heat dissipation fan as claimed in claim 1, wherein an end of the shaft passes through a top surface of a hub of the second rotor to be fixed thereon by riveting, screwing, or adhesion.

5. The heat dissipation fan as claimed in claim 1, wherein the first air-guiding shroud and the second air-guiding shroud are connected to the housing by engaging, riveting, screwing, or adhesion.

6. The heat dissipation fan as claimed in claim 1, wherein the first rotor and the second rotor comprise a hub and the rotor blades disposed around the hub, respectively, the hub of the first rotor is conical or tapered, or has an inclined surface, and the hub of the second rotor is cup-shaped.

7. The heat dissipation fan as claimed in claim 6, wherein the hubs of the first and second rotors comprise a plurality of heat dissipation holes for allowing airflow to pass therethrough so as to dissipate an internal heat of the fan.

8. The heat dissipation fan as claimed in claim 7, wherein an inner surface of each heat dissipation hole is inclined.

9. The heat dissipation fan as claimed in claim 1, wherein the number of static blades is 7, the number of rotor blades of the first rotor is 9 and the number of rotor blades of the second rotor is 8 or 5 or the number of rotor blades of the first rotor is 8 and the number of rotor blades of the second rotor is 9 or 5.

10. The heat dissipation fan as claimed in claim 1, wherein a height ratio of the rotor blades to the static blades ranges from 1:1.1 to 1:2.2.

11. The heat dissipation fan as claimed in claim 1, wherein the housing further comprises a plurality of connecting portions, and the heat dissipation fan is fixed on an external system frame via holes formed on the connecting portions.

12. A heat dissipation fan comprising a housing;

a first rotor comprising a shaft and a plurality of rotor blades;

a second rotor coupled to the first rotor and comprising a plurality of rotor blades;

a base disposed in the housing supporting the first and second rotors and comprising a single motor disposed through the base and supported thereby for driving the first and second rotors;

a plurality of static blades disposed between the housing and the base, wherein a ratio between a height of the rotor blades to the static blades ranges from 1:1.1 to 1:2.2, wherein a stagger angle of the rotor blades of the first rotor differs from a stagger angle of the rotor blades of the second rotor;

a first air-guiding shroud disposed on a side of the housing, wherein the first air-guiding shroud expands outward or is flared; and a second air-guiding shroud disposed on another side of the housing, wherein the second air-guiding shroud comprises a plurality of static blades disposed therein.

13. The heat dissipation fan as claimed in claim 12, wherein an end of the shaft passes through a top surface of a hub of the second rotor to be fixed thereon by riveting, screwing, or adhesion.

14. The heat dissipation fan as claimed in claim 12, wherein a front portion of each static blade is curved, and a rear portion of each static blade extends along an axial line of the heat dissipation fan, and a length of the rear portion is ⅓ to ⅕ of that of the static blade.

* * * * *